United States Patent [19]

Morita et al.

[11] Patent Number: 4,692,086

[45] Date of Patent: Sep. 8, 1987

[54] LOAD HANDLING VEHICLE

[75] Inventors: Shigeru Morita; Nobuhide Yanagawa, both of Osaka, Japan

[73] Assignee: Kubota, Ltd., Osaka, Japan

[21] Appl. No.: 801,338

[22] Filed: Nov. 25, 1985

[30] Foreign Application Priority Data

Nov. 27, 1984 [JP] Japan ..... 59-180274[U]
Nov. 27, 1984 [JP] Japan ..... 59-251077

[51] Int. Cl.[4] ..... B66F 9/075

[52] U.S. Cl. ..... 414/635; 280/759; 414/673

[58] Field of Search ..... 414/629, 630, 631, 632, 414/634, 636, 637, 638, 673; 280/759

[56] References Cited

U.S. PATENT DOCUMENTS

| | | | |
|---|---|---|---|
| 2,178,368 | 10/1939 | Dunham | 414/635 |
| 2,256,314 | 9/1941 | Dunham | 280/759 X |
| 2,381,729 | 8/1945 | Dunham et al. | 414/635 |
| 2,733,825 | 2/1956 | Evans | 414/629 X |
| 2,804,984 | 9/1957 | Ulinski | 414/634 |
| 2,969,991 | 1/1961 | Ulinski | 280/759 |
| 4,189,020 | 2/1980 | Abels et al. | 280/759 X |

FOREIGN PATENT DOCUMENTS

| | | | |
|---|---|---|---|
| 975450 | 11/1964 | United Kingdom | 414/635 |

*Primary Examiner*—Leslie J. Paperner
*Attorney, Agent, or Firm*—Birch, Stewart, Kolasch & Birch

[57] ABSTRACT

A load handling vehicle having a load handling device disposed in front of the vehicle body and tiltable by a pair of opposite tilting cylinders. A main frame extends longitudinally of the vehicle and is fixed to each side of the vehicle body at a plurality of locations spaced apart longitudinally thereof. Each tilting cylinder extends longitudinally of the vehicle and is positioned above and close to the corresponding main frame in the vicinity of the front wheel fender inside thereof. The tilting cylinder is connected to a bracket on the main frame in the vicinity of and above the front axle and terminates at a position below the steering assembly of the vehicle. The arrangement of the cylinders permits the device to be positioned close to the vehicle body, enabling the driver to obtain a good forward view. The vehicle body is reinforced by the main frames against fracture.

16 Claims, 10 Drawing Figures

LOAD HANDLING VEHICLE

FIELD OF THE INVENTION AND RELATED ART STATEMENT

The present invention relates to a load handling vehicle having a load handling device attached to the front portion of its body.

Load handling vehicles equipped with a forklift or like load handling device in front of the vehicle body comprises a pair of front wheel fenders disposed on opposite sides of the vehicle body and covering the front wheels, steering means including a steering handle and arranged between the fenders and a front cover provided between the fenders and covering at least the lower portion of the steering means from the front. The load handling device is positioned in front of the front cover.

The load handling device of the type mentioned comprises a pair of stationary masts connected to each other and each tiltably pivoted at its lower portion to the vehicle body by a lateral pin. Tilting cylinders are provided between the vehicle body and the stationary masts to tilt the device in its entirety.

However, because the tilt cylinder is usually connected to a bracket on the front end of the vehicle body, the tilt cylinder becomes an obstacle which makes it impossible to position the load handling device close to the vehicle body. The vehicle is therefore likely to fall down during operation and is unable to handle articles of increased weight with the device.

Furthermore, the load handling device, which is positioned away from the vehicle body in front thereof, greatly limits the field of view of the rider in the driver's seat, consequently presenting difficulty in driving the vehicle for handling articles in places of narrow space.

Further when the vehicle body comprises a transmission case, clutch housing, etc. which are joined together by bolts as arranged longitudinally of the vehicle, a great bending force acts on the vehicle body when an article is hoisted by the load handling device, possibly breaking some of the bolts to fracture the vehicle body. The weight of articles to be handled is therefore limited.

OBJECTS AND SUMMARY OF THE INVENTION

The present invention has overcome the above problems heretofore encountered.

A first object of the present invention is to provide a load handling vehicle wherein a load handling device can be positioned close to the vehicle body so that heavy articles can be handled by the device with safety without the likelihood of falling down or other accident.

A second object of the present invention is to provide a load handling vehicle wherein a load handling device can be positioned close to the vehicle body to offer the driver at his seat an unobstructed forward view, especially a good forwardly downward view toward a position close to the vehicle body, and which is thereby made easy to drive for loading or unloading operation.

A third object of the present invention is to provide a load handling vehicle having a vehicle body which is reinforced by a pair of opposite main frames and which is prevented from fracture even when loaded during operation.

A fourth object of the present invention is to provide a load handling vehicle wherein although a load handling device is positioned close to the vehicle body, the tilting cylinders for the device are so arranged that they will not become an obstacle to the feet of the driver.

Other objects of the present invention will become more apparent from the following description with reference to the accompanying drawings.

To fulfill the above objects, the present invention provides a load handling vehicle including steering means disposed between a pair of front wheel fenders on opposite sides of the body of the vehicle for covering front wheels, a front cover disposed between the pair of front wheel fenders for covering the lower portion of the steering means from the front, a load handling device disposed in front of the front cover and tiltably attached to the front end of the vehicle body, and a pair of opposite tilting cylinders provided between the load handling device and the vehicle body for tilting the device, the load handling vehicle being characterized in that a main frame extends longitudinally of the vehicle and is fixed to each side of the vehicle body at a plurality of locations spaced apart longitudinally thereof, each of the tilting cylinders extending longitudinally of the vehicle and positioned above and close to the corresponding main frame in the vicinity of the front wheel fender inside thereof, each tilting cylinder being connected to a bracket on the main frame in the vicinity of and above a front axle supporting the front wheel, each tilting cylinder terminating at a position below the steering means.

DESCRIPTION OF THE PREFERRED EMBODIMENT

Figure 2:
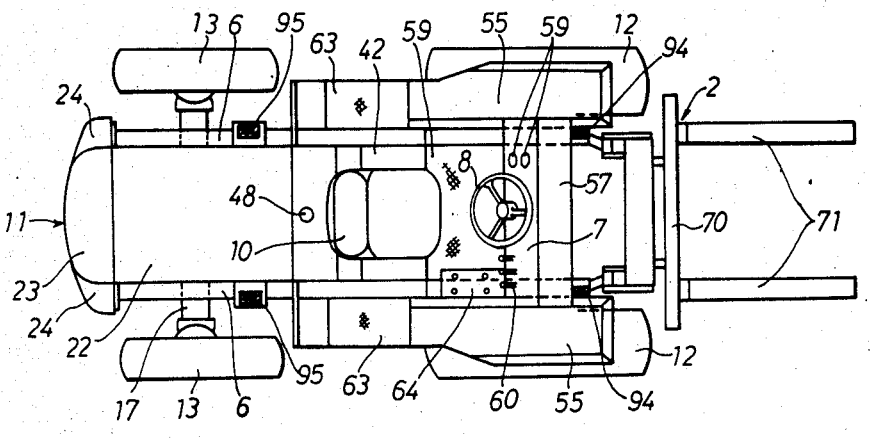
FIG. 2 is a plan view showing the vehicle in its entirety.
Figure 1:
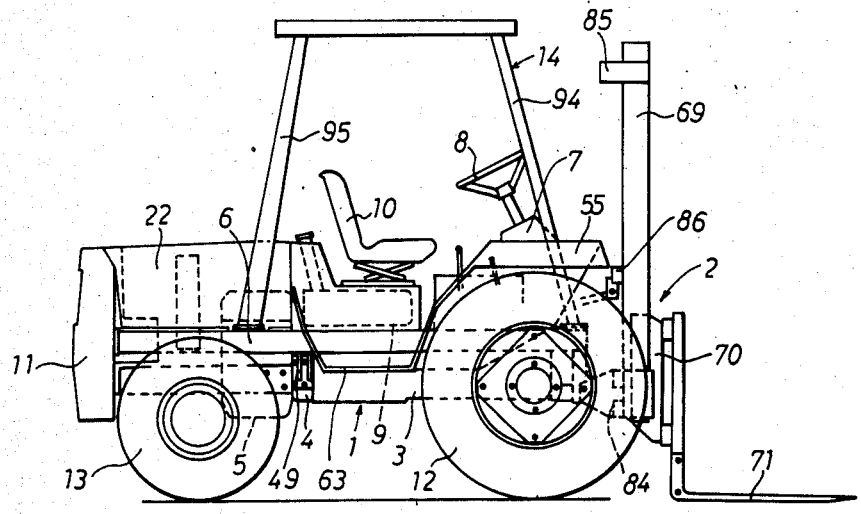
FIG. 1 is an overall side elevation showing a load handling vehicle embodying the invention.

The present invention will be described below in detail with reference to the illustrated preferred embodiment. FIGS. 1 and 2 show a load handling vehicle having a forklift 2 attached to the front end of the body 1 of the vehicle.

The vehicle body 1 comprises a transmission case 3, a clutch housing 4 and an engine 5 which are arranged in series longitudinally of the vehicle and joined together by bolts. A pair of main frames 6 extending longitudinally of the vehicle body 1 are provided on opposite sides of the body 1 at its upper portion. The vehicle body 1 is provided with an operation panel 7, a steering wheel 8, etc. at its front portion, a fuel tank 9, a driver's seat 10, etc. at its midportion and a weight 11 serving also as a grille at its rear end. The vehicle body further has front wheels 12, rear wheels 13 and a safety frame 14.

Figure 3:
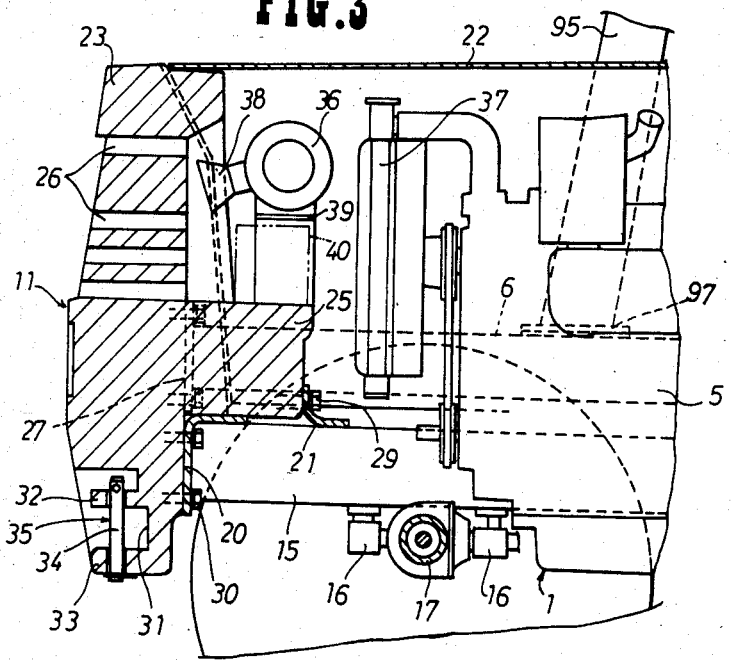
FIG. 3 is a side elevation partly broken away and showing a rear portion of the vehicle.
Figure 4:
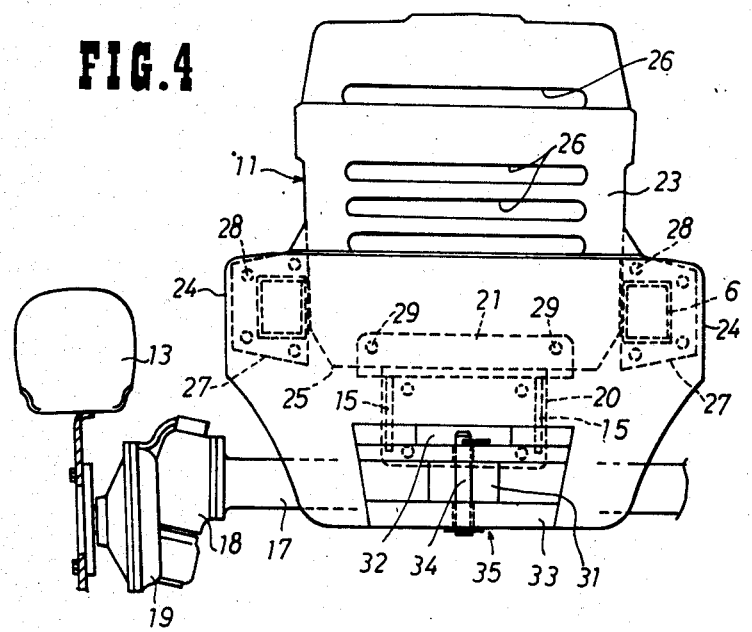
FIG. 4 is a rear view partly broken away and showing the vehicle.
Figure 5:
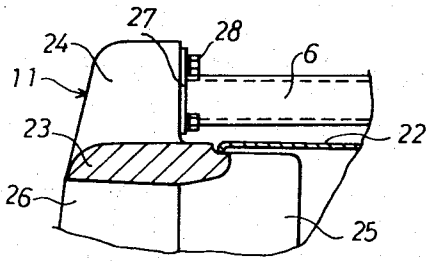
FIG. 5 is a fragmentary plan view showing a weight in section as it is attached to the rear end of the vehicle.

With reference to FIGS. 3 and 4, the engine 5 is provided on its opposite sides with rear axle frames 15 projecting rearward. Rear axle cases 17 pivotally movable about a center pin are supported by pairs of front and rear brackets 16 on the frames 15. The rear wheel 13 which is turnable about a vertical kingpin for steering is mounted on the outer end of each rear axle case 17 by gear cases 18 and 19. The rear ends of the rear axle frames 15 are interconnected by a connecting plate 20. A weight 11 is mounted on the rear ends of the frames 15 by the connecting plate 20 and an attaching plate 21. As seen in FIGS. 3 to 5, the weight 11 serving also as a grille covers the open rear end of a bonnet 22 covering the engine 5, etc. The weight 11 comprises a main portion 23 conforming to the shape of the bonnet 22, protruding portions 24 projecting outward from the opposite sides of the main portion 23, and a mount portion 25 projecting forward from the main portion 23 toward the engine 5. The main portion 23 is formed with a plurality of air inlet apertures 26 arranged one above another and extending transversely of the vehicle. Each protruding portion 24 is attached to a plate 27 on the rear end of the main frame 6 by bolts 28, while the mount portion 25 is placed on the connecting plate 20 for the frames 15 and fastened to the attaching plate 21 by bolts 29. The connecting plate 20 is fastened to the main portion 23 by bolts 30. A cavity 31 is formed in the rear side of the main portion 23 close to its lower end. A hitch pin 34 is removably inserted through a projecting wall 32 in the cavity 31 and the lower end wall 33 defining the cavity, thus providing a hitch 35 for pulling a trailer or the like. The rear edge of the bonnet 22 fits around the main portion 23 of the weight 11 at the front side thereof. As seen in FIG. 3, the bonnet 22 houses an air cleaner 36, radiator 37, etc., in addition to the engine 5. The air cleaner 36 is supported by a bracket 39 on the mount portion 25, with its intake 38 directed toward the air inlet aperture 26 of the weight 11. A battery 40 may be provided on the mount portion 25.

Figure 6:
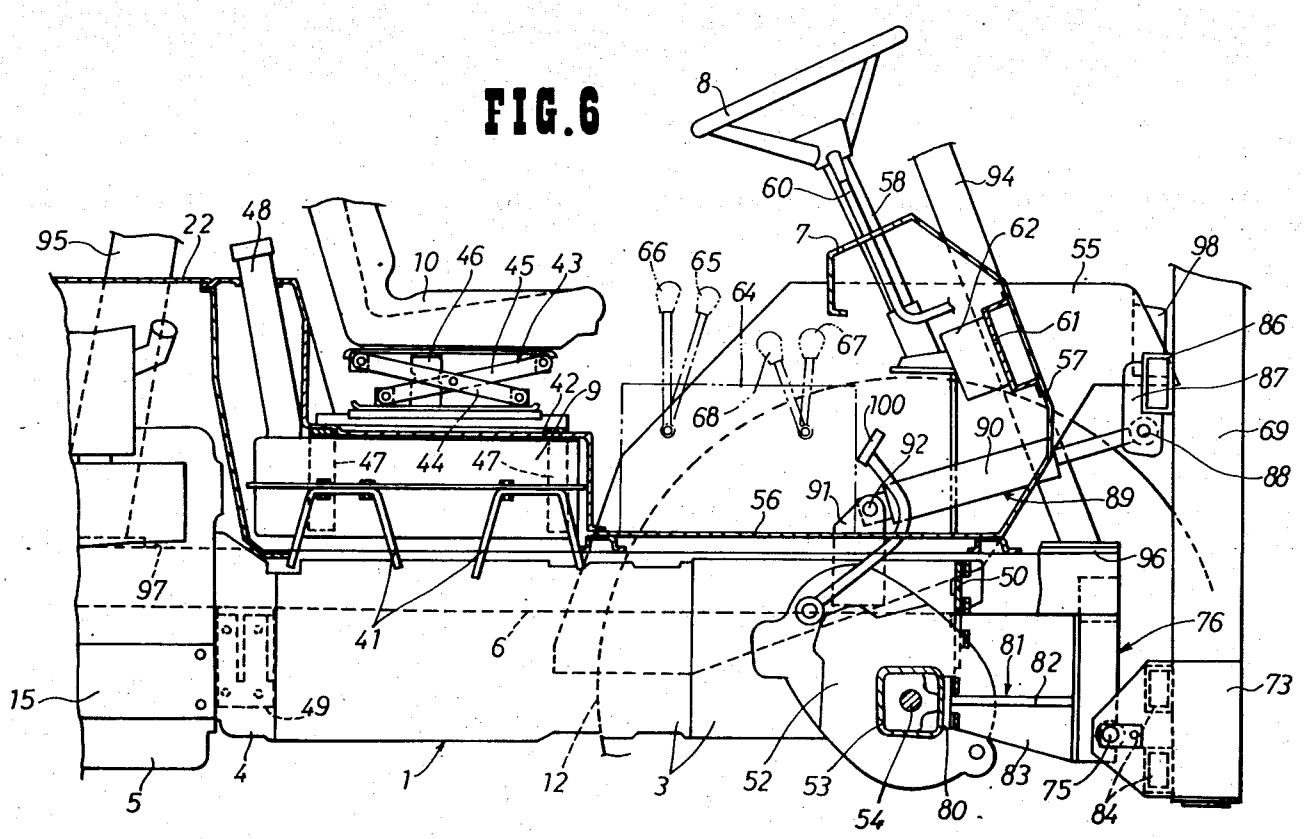
FIG. 6 is a side elevation partly broken away and showing the front portion of the vehicle.

The fuel tank 9, which is disposed above the midportion of the vehicle body 1 and in the form of a flat container, is mounted on brackets 41 on the opposed main frames 6 as shown in FIG. 6 and covered with a tank cover 42. The driver's seat 10 is mounted on a support assembly 43 on the tank cover 42 which is L-shaped when seen from one side. The support assembly 43 comprises links 44, 45, cushion 46, etc. and is adapted to adjust the position of the driver's seat 43 vertically and longitudinally of the vehicle. The tank cover 42 is supported by inverted U-shaped reinforcing members 47 interconnecting the opposed brackets 41. The fuel tank 9 has an oil inlet 48 extending upward from a rear end portion of the tank 9 behind the seat 10.

Figure 7:
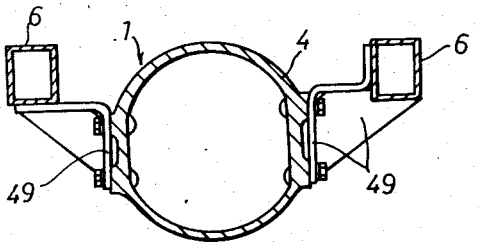
FIG. 7 is a sectional view showing a clutch housing.
Figure 9:
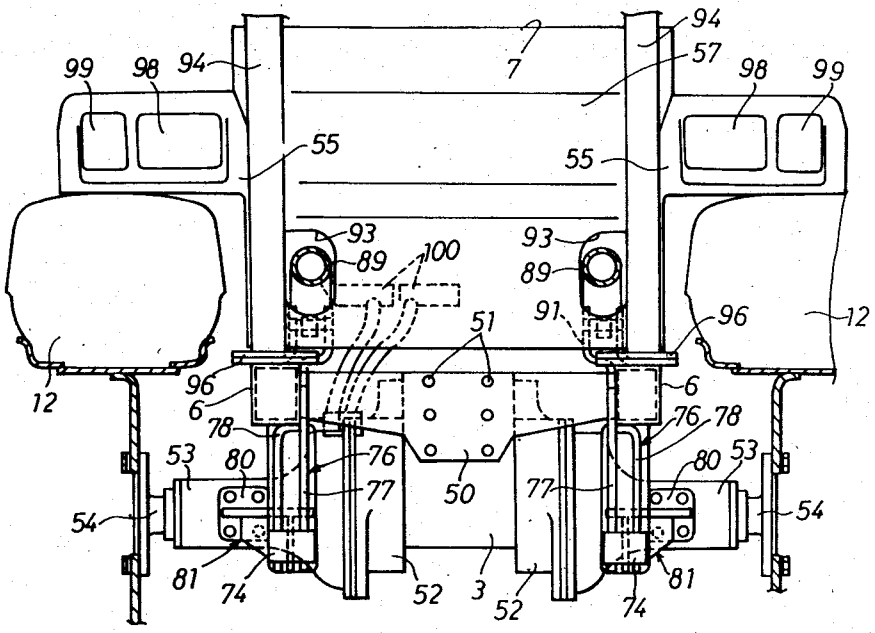
FIG. 9 is a front view in section showing the front portion of the vehicle.
Figure 8:
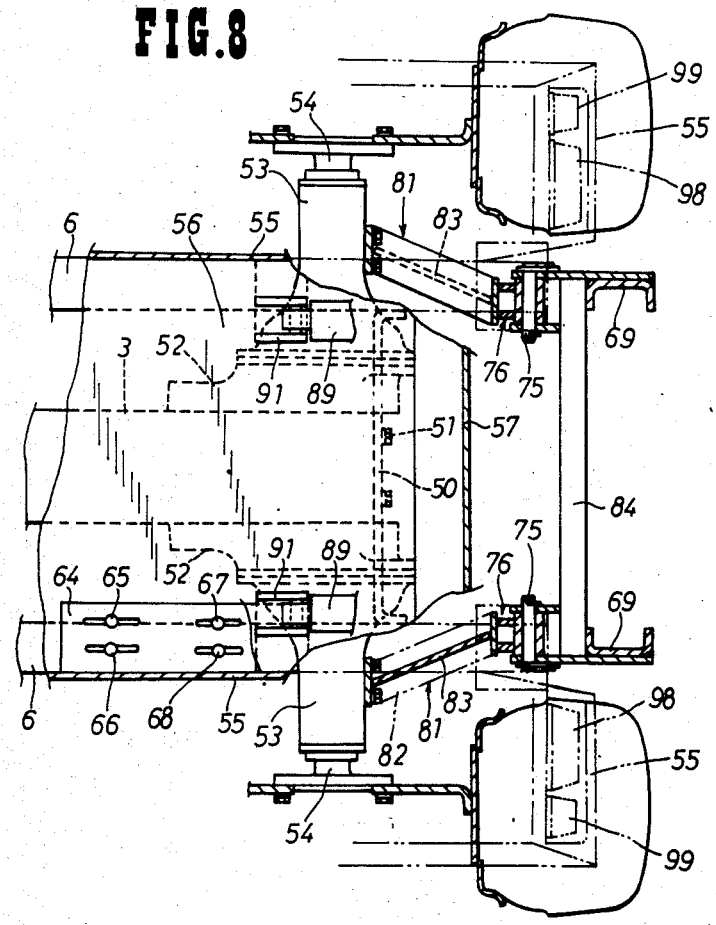
FIG. 8 is a plan view partly broken away and showing the front portion of the vehicle.

As shown in FIG. 7, the vehicle body 1 is connected to the opposed main frames 6 by brackets 49 on opposite sides of the clutch housing 4. As seen in FIGS. 6, 8 and 9, the body 1 is connected to the main frames 6 by the connecting plate 50 also at the front end of the transmission case 3. More specifically, the main frames 6 are interconnected at their front end portions by the connecting plate 50 which is fastened to the front end of the case 3 by bolts 51. Thus, the opposed main frames 6 are fixed to the vehicle body 1 at a plurality of locations spaced apart longitudinally of the vehicle by the connecting plate 50, brackets 49 and the weight 11 to reinforce the body 1.

With reference to FIGS. 8 and 9, each front wheel 12 is supported by a terminal speed reduction case 52, front axle case 53, front axle 54, etc. at each side of the transmission case 3 at its front end. Each front wheel 12 is covered with a fender 55 from inside. The fender 55 is fastened to suitable portions of the main frame 6, etc. The opposed front wheel fenders 55 are interconnected by a step plate 56 covering the transmission case 3 from above and positioned in front of the tank cover 42, a front cover 57 extending upward from the front end of the step plate 56, and the operation panel 7 extending from the upper end of the front cover 57 and bent rearwardly downward. The operation panel 7 is provided with a post 58 in the transverse middle portion thereof for supporting the steering wheel 8 and with various instruments 59 and control levers 60 on opposite sides of the post 58. The control levers 60 are arranged transversely for a hydraulic control valve unit 62 mounted on a reinforcing member 61 on the rear side of the front cover 57. The forklift 2 is controllable by these levers 60. Through unillustrated means, the rear wheels 13 are turnable each about a kingpin by the wheel 8 for steering the rear wheels 13. While the steering wheel 8 and the control levers 60 are shown as the steering means, the means may further include other members. A step plate 63 for the driver to ride in the vehicle is provided in the rear of the lower end of the front wheel fender 55. Disposed inside the right front wheel fender 55 is a lever box 64 which is provided with a main speed change lever 65, forward-reverse change lever 66, high-low speed change lever 67 and on-off lever 68 for driving the rear wheels. When the lever 68 is in on position, the four wheels 12, 13 are driven, while when it is in off position, only two wheels, i.e., the front wheels 12, are driven.

Figure 10:
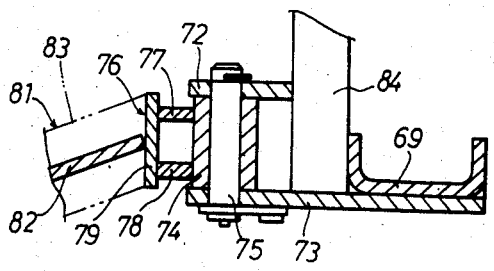
FIG. 10 is a fragmentary plan view in section showing a mount assembly for a lift.

The lift device 2 comprises a pair of opposite fixed masts 69, a lift member 70 mounted thereon by lift masts or the like, a fork 71 removably mounted on the lift member 70, etc. When required, the fork 71 is replaceable by a bucket or the like. As shown in FIG. 10, each fixed mast 69 has a pair of brackets 72, 73 projecting rearward from opposite sides of its lower end. A boss portion 74 connected to the vehicle body 1 is removably fitted in the the space between the brackets 72, 73 from behind and is connected to the brackets by a removable pin 75. The boss portion 74 is attached to the lower end of a support member 76 extending downward from the front end of the main frame 6. The support member 76 comprises two parallel strips 77, 78 and another strip 79 secured thereto for reinforcement. The boss portion 74 is attached to both the strips 77, 78. The support member 76 is reinforced by a reinforcing member 81 fixed to the front axle case 53 by an attaching plate 80. The reinforcing member 81 comprises a strip 82 and a reinforcing plate 83 which are joined together in a T-form. The opposite reinforcing members 81 are spaced apart from each other transversely of the vehicle body by an increasing disance as they extend rearward from the support members 76. The opposed fixed masts 69 are interconnected by connecting members 84, 85 and 86 at their lower ends having the brackes 73, upper ends and intermediate portions. A pair of tilting cylinders 89 are connected to the intermediate connecting member 86, each by a bracket 87 and a pin 88. The body 90 of each cylinder is pivoted by a pin 92 to a bracket 91 which is attached to the main frame 6 in the vicinity of and above the front axle 54 and in the vicinity of the front wheel fender 55 inside thereof. The front cover 57 is formed with holes 93 for the tilting cylinders 89 to extend therethrough.

The safety frame 14 comprises four posts, i.e., front posts 94 and rear posts 95. The front posts 94 are mounted on attaching plates 96 at the front ends of the main frames 6. The rear posts 95 are mounted on attaching plates 97 on the main frames 6 at opposite sides of the engine 5. Each front wheel fender 55 is provided with a headlight 98 and a winker 99 at its front end upper portion. Indicated at 100 are a pair of brake pedals by which brakes incorporated inside the opposite terminal speed reduction cases 52 can be operated at the same time or individually.

For handling articles with the fork 71, the driver in the seat 10 operates the vehicle. Various levers for the running system, such as the main speed change lever 65, the forward-reverse change lever 66, the high-low change lever 67, the on-off lever 68, etc. are all concentrically provided on the left side of the driver's seat in front thereof and are therefore easy to manipulate for operation.

The lift device 2 is operated by the control levers 60. When one of the control levers 60 is manipulated, the pistons of the tilting cylinders 89 advance or retract, tilting the fixed masts 69 forward or backward about the pins 75. Because the support members 76 extend downward from the main frames 6, with the fixed masts 69 pivoted to the lower ends of the members 76 by the pins 75, the device 2 is supported at a low point for the tilting movement and can be held in a stable position. The tilting cylinders 89 extend rearward and terminate at a position below the steering means, with their rear ends positioned above and in the vicinity of the front axles 54 within the cases 53, so that the device can be positioned closer to the vehicle body 1 than when the brackets for the cylinders are provided at the front end of the vehicle body 1. In addition to this arrangement of the cylinders 89, the arrangement wherein the fixed masts 69 of the lift device 2 are disposed between the opposed front wheels 12 makes it possible to position the lift device 2 close to the vehicle body 1 to the greatest possible extent, enabling the device 2 to handle heavy articles with good stability. Moreover, the arrangement wherein the lift device 2 is close to the vehicle body 1 enables the driver in the seat 10 to obtain a good forward view and to operate the vehicle easily during article handling operation.

Although arranged between the opposite front wheel fenders 55, the tilting cylinders 89 are disposed very close to the fenders 55 and therefore will not interfere with the feet of the driver, permitting the driver to have a sufficient space on the step plate 56.

The balance 11 is attached to the rear end of the vehicle body 1 and positioned to the rear of the rear wheels 13. This holds the vehicle under gravity in good balance longitudinally thereof when the lift device 2 handles heavy articles, permitting the lift device 2 to handle articles of increased weight. The weight 11 is in conformity with the shape of the bonnet 22, serves also as a grille having air inlet apertures 26 to eliminate the need to provide a specific grille, is easy to attach to the vehicle body 1 and is not susceptible to a break at the attached portion even if having an increased weight. Because the weight 11 is partly positioned within the bonnet 22, it is easy to give the desired weight to the member 11. While the weight 11 has the plurality of air inlet apertures 26 as arranged one above another, the spacing between the apertures at the portion opposed to intake 38 of the air cleaner 36 may be made larger as seen in FIG. 3, whereby direct ingress of water into the intake 38 can be prevented during washing of the vehicle.

While the vehicle body 1 comprises transmission case 3, clutch housing 4 and engine 5 arranged end-to-end longitudinally of the vehicle and joined together by bolts, the main frames 6 are arranged on opposite sides of the body 1 at its upper portion and are connected to the case 3 by the connecting plate 50 at the body front end, to the clutch housing 4 by the intermediate brackets 49 and to the rear axle frames 15 by the weight 11 at the rear end. The main frames 6 therefore afford remarkably enhanced strength to the body 1. In the case where the lift device 2 is positioned to the front of the front wheels 12, with the weight 11 to the rear of the rear wheels 13, a bending force will act on the body 1 to bend the midportion thereof upward, whereas the main frames 6 which are provided at the upper portion of the vehicle body 1 reinforce the body 1 against the bending force, eliminating the likelihood that the bolts joining the case 3, housing 4, etc. together will break. When the main frames 6 are provided at the upper portion, the step plate 56 can be provided over the frames 6 thereacross for the effective use of the space above the vehicle body 1.

The fuel tank 9 in the form of a flat container and disposed under the driver's seat at the midportion of the vehicle body 1 serves to effectively utilize the dead space below the seat 10, while the tank can be given a sufficient capacity. More specifically, to assure the driver of a good forward view, the seat 10 needs to be at an elevated level above the body 1 to leave a dead space below the seat 10, so that the fuel tank 9 can be provided in this space. This arrangement gives a larger capacity to the fuel tank 9 than when it is accommodated in the limited interior space of the bonnet 22 covering the engine 5, etc. A battery may be provided in the space along with the fuel tank 9.

The opposite front wheel fenders 55, which are interconnected by the front cover 57 and the operation panel 7, are less susceptible to jolts or shakes. The front cover 57 which covers the space above the step plate 56 from the front protects the feet and legs of the driver and has a good appearance.

When a trailer or the like is to be pulled along, the hauling bar is connected to the vehicle by the hitch pin 34 on the weight. Since the hitch point is rearwardly away from the rear wheels 13 with no obstacle present therearound, the assembly is turnable with a minimum radius.

The safety frame 14 around the driver's seat 10 assures the driver of safety. Because the front posts 94 and the rear posts 95 are mounted on the main frames 6 by the plates 96, 97, the frame 14 has great strength and is easy to mount. If the front wheel fenders 55 are high, the front posts 94 may be mounted on the fenders 55, but the fenders then need reinforcement. This involves various problems in respect of strength and assembling work efficiency. However, when the posts are mounted on the main frames 6, these problems can be overcome.

Although the lift device 2 with the fork 71 is used as the load handling device according to the embodiment described, a bucket may be used in place of the fork 71. Alternatively a device for clamping lumber may be used.

What is claimed is:

1. A load handling vehicle including steering means disposed between a pair of front wheel fenders on opposite sides of the body of the vehicle for covering front wheels, a front cover disposed between the pair of front wheel fenders and covering the lower portion of the steering means from the front, a load handling device disposed in front of the front cover and tiltably attached to the front end of the vehicle body, and a pair of opposite tilting cylinders provided between the load handling device and the vehicle body for tilting the device, the load handling vehicle being characterized in that a main frame extends longitudinally of the vehicle and is fixed to each side of the vehicle body at a plurality of locations spaced apart longitudinally thereof, each of the tilting cylinders extending longitudinally of the vehicle and positioned above and close to the corresponding main frame in the vicinity of the front wheel fender inside thereof, each tilting cylinder being connected to a bracket on the main frame in the vicinity of and above a front axle supporting the front wheel, each tilting cylinder terminating at a position below the steering means, the load handling device is tiltably mounted on a support member extending downward from the front end of each main frame, and the support member is connected by a reinforcing member to a front axle case attached to each side of the vehicle body for supporting the front wheel.

2. A load handling vehicle as defined in claim 1 wherein the reinforcing members on opposite sides of the vehicle body are spaced apart from each other transversely of the vehicle body by an increasing distance as they extend rearward from the support members, and the rear end of each reinforcing member is attached to the front axle case at a position transversely outward of the main frame.

3. A load handling vehicle comprising: a vehicle body defined by a longitudinal combination of a transmission case, a clutch housing and an engine; a pair of opposed front wheels mounted at two sides of the body front with a front axle case interposed; a steering means mounted between a pair of front wheel fenders which cover the pair of front wheels; a front cover covering the steering means in front thereof; a load handling device mounted tiltably to the body front, being in front of the front cover; a pair of opposed tilt cylinders for driving the load handling device, being mounted between the device and the body;

wherein a pair of main frames are secured at multiple locations to the body longitudinally at two sides and at an upper level of the body vertically; a pair of support members extending downwardly below the main frames are disposed at each front end of the main frames; the load handling device is mounted tiltably at the lower end of the support members; the pair of tilt cylinders are disposed longitudinally to be close above the main frames and to be close inside of the front fenders; the tilt cylinders are also connected to brackets secured to the pair of main frames close above the front axle case so that ends of the tilt cylinders are disposed below the steering means.

4. A load handling vehicle as noted in claim 3, wherein the pair of opposed support members are connected to the body with the aid of reinforcing members.

5. A load handling vehicle as noted in claim 4, wherein the pair of opposed support members are connected to the front axle case with reinforcing members.

6. A load handling vehicle as noted in claim 4, wherein the reinforcing members on opposite sides of the vehicle body are spaced from each other transversely of the vehicle body with an increasing distance as they extend rearward from the support members, and the rear end of each reinforcing member is attached to the front axle case at a position transversely outward of the main frame.

7. A load handling vehicle as noted in claim 5, wherein the reinforcing members on opposite sides of the vehicle body are spaced from each other transversely of the vehicle body with an increasing distance as they extend rearward from the support members, and the rear end of each reinforcing member is attached to the front axle case at a position transversely outward of the main frame.

8. A load handling vehicle as noted in claim 3, wherein a hole is formed in a lower portion of the front cover at each of opposite sides, and the tilt cylinder extends through the hole longitudinally of the vehicle.

9. A load handling vehicle as noted in claim 3, wherein the opposite main frames are interconnected at their front portions by a connecting plate fixed to the front end of the vehicle body.

10. A load handling vehicle as noted in claim 3, wherein the pair of opposed main frames are connected at their rear ends with a weight which is mounted at the body rear.

11. A load handling vehicle as noted in claim 3, wherein the pair of opposed main frames are secured at their fronts to the transmission case with aid of the connecting plate at their intermediates to the clutch housing with aid of mounting brackets, and at their rears to the rear axle frame with aid of a weight.

12. A load handling vehicle comprising: a steering means mounted between a pair of front wheel fenders which cover a pair of front wheels provided at opposite sides of a vehicular body; a front cover covering the steering means in front thereof; a load handling device mounted tiltably to the body front, being in front of the front cover; a pair of opposed tilt cylinder for driving the load handling device, being mounted between the device and the body;

wherein a pair of main frames are secured at multiple locations to the body longitudinally at two sides; a pair of support members extending downwardly below the main frames are disposed at each front end of the main frames; the load handling device is mounted tiltably to the support members; the support members are connected by a reinforcing member to a front axle case mounted at opposite sides of the body for supporting the front wheels; the pair of opposed tilt cylinders are connected to a bracket secured to the pair of main frames close above the front axle case so that ends of tilt cylinders are disposed below the steering means.

13. A load handling vehicle as noted in claim 12, wherein the reinforcing members on opposite sides of the vehicle body are spaced from each other transversely of the vehicle body with an increasing distance as they extend rearward from the support members, and the rear end of each reinforcing member is attached to the front axle case at a position transversely outward of the main frame.

14. A load handling vehicle as noted in claim 12, wherein a hole is formed in a lower portion of the front cover at each of opposite sides, and the tilt cylinder extends through the hole longitudinally of the vehicle.

15. A load handling vehicle as noted in claim 12, wherein the opposite main frames are interconnected at their front portions by a connecting plate fixed to the front end of the vehicle body.

16. A load handling vehicle as noted in claim 12, wherein the pair of opposite main frames are connected at their rear ends with a weight which is mounted at the body rear.

* * * * *